US007779568B2

(12) United States Patent
Gettelfinger et al.

(10) Patent No.: US 7,779,568 B2
(45) Date of Patent: Aug. 24, 2010

(54) ADJUSTABLE LED SIGN MOUNTING SYSTEM

(75) Inventors: Lee A. Gettelfinger, Mequon, WI (US); Gregory P. Schleusner, Waukesha, WI (US); Kelly J. Bronk, Kewaskum, WI (US)

(73) Assignee: Adaptive Micro Systems LLC, Milwaukee, WI (US)

( * ) Notice: Subject to any disclaimer, the term of this patent is extended or adjusted under 35 U.S.C. 154(b) by 354 days.

(21) Appl. No.: 12/049,944

(22) Filed: Mar. 17, 2008

(65) Prior Publication Data

US 2009/0229156 A1 Sep. 17, 2009

(51) Int. Cl.
*G09F 15/00* (2006.01)

(52) U.S. Cl. ..... 40/624; 40/606.15; 40/607.11; 248/218.4

(58) Field of Classification Search ..... 40/601, 40/606.01, 606.14, 606.15, 607.11, 624, 40/607.13, 612; 248/274.1, 299.1, 201, 218.4, 248/219.2, 276.1, 295.11, 255
See application file for complete search history.

(56) References Cited

U.S. PATENT DOCUMENTS

| | | | | |
|---|---|---|---|---|
| 1,009,727 | A | 11/1911 | Duigan | |
| 1,068,250 | A * | 7/1913 | Koenig | 248/201 |
| 1,789,849 | A | 1/1931 | Speck | |
| 1,841,204 | A | 1/1932 | Overholtz | |
| 2,121,704 | A * | 6/1938 | Leeworthy | 248/235 |
| 2,512,515 | A * | 6/1950 | Bauers et al. | 40/601 |
| 2,512,519 | A * | 6/1950 | Covington et al. | 40/601 |
| 2,772,495 | A | 12/1956 | Daniels | |
| 2,948,976 | A * | 8/1960 | Miller, Jr. | 40/624 |
| 3,066,757 | A * | 12/1962 | Robinson et al. | 182/36 |
| 3,120,069 | A | 2/1964 | Pfaff, Jr. et al. | |
| 3,150,455 | A * | 9/1964 | Indorf | 40/624 |
| 4,151,971 | A * | 5/1979 | Daly et al. | 248/286.1 |
| 4,687,305 | A | 8/1987 | Harris, Jr. et al. | |
| 6,918,200 | B2 | 7/2005 | Pena | |
| 7,258,197 | B1 * | 8/2007 | Wicks | 182/82 |
| 2002/0190180 | A1 * | 12/2002 | Cotterill | 248/370 |
| 2005/0050779 | A1 | 3/2005 | Tsao | |
| 2005/0253035 | A1 | 11/2005 | Dozier | |
| 2006/0065800 | A1 | 3/2006 | Bremmon | |

* cited by examiner

*Primary Examiner*—Gary C Hoge
(74) *Attorney, Agent, or Firm*—Foley & Lardner LLP

(57) ABSTRACT

An adaptable mounting system for mounting an LED display panel on an existing support structure for a billboard is provided, where the support structure including a plurality of posts having brackets arranged to support the billboard. The adaptable mounting system includes a lower arm and upper arms, each arm having a first end and a second end and one or more notches supported on the brackets of the existing support structure; a yoke coupled to the arms proximate the first end and configured for attachment to the LED display panel; and a brace coupled to one of the upper arms proximate the second end and coupled to the yoke of an arm beneath the one of the upper arms.

20 Claims, 4 Drawing Sheets

ADJUSTABLE LED SIGN MOUNTING SYSTEM

BACKGROUND

The present invention relates generally to the field of display signs. The present invention relates more particularly to LED display signs having an adjustable angle mounting system. The present invention relates more particularly to LED display signs having an adjustable angle mounting system adapted to mount on conventional (e.g. non-LED) billboard support structures.

Mounting systems for elevated display signs such as billboards and the like are generally known. Some of such known signs may be angled downward to some extent to enhance visibility by ground-level observers. However, such typical mounting systems do not generally permit an angle of adjustment to be varied or customized to suit the particular desired visibility characteristics for both the type of sign, and the type/location of observers. Further, such typical mounting systems for billboards and the like are not readily adaptable for use LED display signs with angle adjustment features.

For example, LED display signs are often constructed from a large number of individual LEDs having specially selected light emitting characteristics. In the example of billboard LED display signs, the LEDs are selected so that light emitted by the LEDs maintains its brightness and off-angle viewing to a greater extent as an observer moves from side-to-side (referred to as "off angle" relative to the sign) and to a lesser extent as an observer moves up or down (relative to the sign), in order to better target mobile ground-level observers.

As conventional billboards become obsolete and replaced by LED display signs, it would be advantageous to provide an adjustable mounting system for an LED display sign that allows the LED display sign to be mounted on existing support structures for conventional billboards.

SUMMARY

One embodiment relates to an adaptable mounting system for mounting an LED display panel on an existing support structure for a billboard, the support structure including a plurality of posts having brackets arranged to support the billboard. The adaptable mounting system includes a lower arm and a plurality of upper arms, each arm having a first end and a second end and one or more notches configured to be supported on the brackets of the existing support structure; a yoke coupled to the arms proximate the first end and configured for attachment to the LED display panel; and a brace coupled to one of the upper arms proximate the second end and coupled to the yoke of an arm beneath the one of the upper arms.

Another embodiment relates to an adaptable mounting system for mounting an LED display panel on an existing support structure for a billboard, the support structure including a plurality of posts having brackets arranged to support the billboard. The adaptable mounting system includes a lower arm, a plurality of upper arms each having two or more openings, and at least one brace extending between two of the arms and adjustable to any one of a plurality of positions to accommodate tilting of the LED display panel to any one of the plurality of predetermined viewing angles. The lower arm has a first end coupled to the LED display panel and has an opening configured to fit over a lower one of the brackets on one of the posts to define a pivot axis about which the LED display sign may be tilted to any one of a plurality of predetermined viewing angles. The openings are located on the upper arms to correspond to the plurality of predetermined viewing angles and configured to fit over upper ones of the brackets on the one of the posts, each upper arm also having a first end coupled to the LED display panel.

Another embodiment relates to a method of mounting an LED display panel on an existing support structure for a billboard, the support structure including a plurality of posts having brackets arranged to support the billboard. The method includes providing a lower arm having an opening and having a first end; coupling the first end of the lower arm to the LED display panel; providing a plurality of upper arms each having two or more openings and having a first end; coupling the first end of the upper arms to the LED display panel; fitting the opening in the lower arm and one of the openings in each of the upper arms over a corresponding bracket on one of the plurality of posts; and connecting at least one brace between two of the arms.

DETAILED DESCRIPTION

Figure 1:
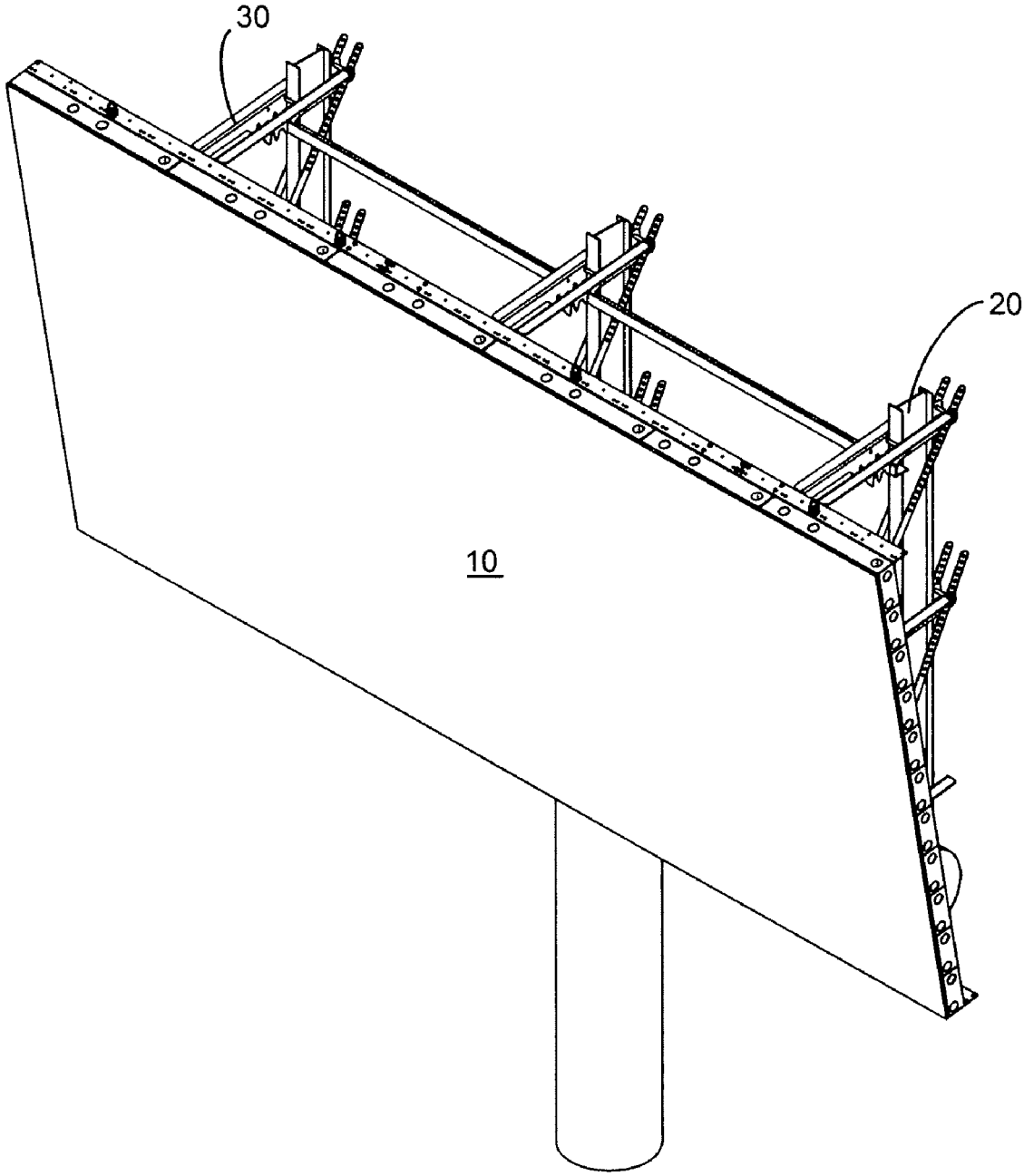
FIG. 1 is an isometric view of a display panel such as a billboard according to an exemplary embodiment.

FIG. 1 is an isometric view of a display panel 10 such as an LED display sign for use in replacement of a conventional billboard sign. The display panel 10 is coupled to an existing support structure 20 (previously provided for use with the conventional billboard sign) by use of an adjustable mounting system 30, such as when it may be desirable to replace the conventional billboard sign with an LED display sign, without replacing the support structure for the sign. Such support structures 20 generally include one or more vertical members or posts 22 and a multitude of brackets 24 coupled to each post 22 configured to receive the billboard. Existing support structures 20 are generally configured to support conventional billboards that are bolted or otherwise fixably coupled to brackets 24.

According to an exemplary embodiment, display panel 10 may be an LED display system. Adjustable mounting system 30 is intended to permit display panel 10 to be installed at any one of a variety of angles, so that display panel 10 is "tipped" (e.g. tilted, rotated, pivoted, etc.) about a generally horizontal axis 12 for enhanced observation by observers at a relatively constant elevation (e.g. "ground-level"). Adjustable mounting system 30 permits the display panel 10 to be tilted downward at any one of a variety of angles to provide increased light intensity to the ground-level observer (and thus better visibility) corresponding to the particular light emitting characteristics of the LEDs used in display panel 10.

Figure 2:
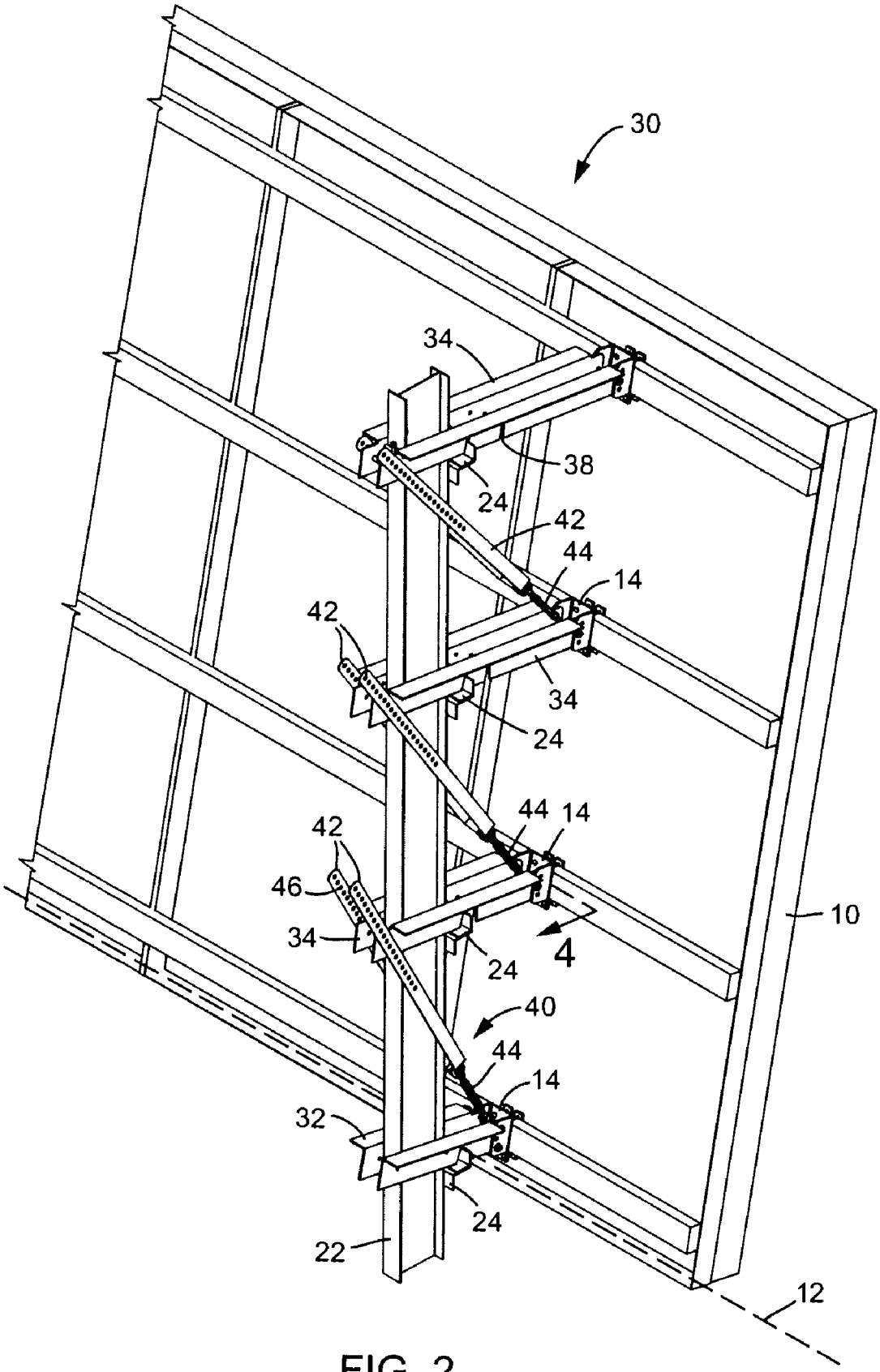
FIG. 2 is a rear isometric view of the display panel of FIG. 1 showing an adjustable mounting system coupling an LCD display panel to an existing support structure according to an exemplary embodiment.

As shown better in FIG. 2, adjustable mounting system 30 includes a multitude of arms 32 and 34 (where arm 32 is shown to be a "lower arm" and arm 34 is shown to be an "upper arm"). Arms 32 and 34 have a first end proximate to support structure 20 and a second end coupled to display system 10. Each of arms 32 and 34 are shown for example to comprise two spaced apart members provided on either side of post 22. According to the illustrated embodiment, arms 32 and 34 are coupled to yokes 14 provided on the back side of display panel with a coupling member 16 (e.g., pin, bolt, etc.) such that they provide a fixed or rigid connection. One or more braces 40 (e.g., support member, tensioning member, etc.) are provided with a first end coupled to each arm 34 and a second end coupled to the arm below each arm 34.

Lower arm 32 is provided proximate to the bottom edge of display panel 1O. Lower arm 32 includes a notch 36 (e.g., opening, recess, etc.). Notch 36 receives one end of a bracket 24 on support structure 20. Lower arm 32 is generally "fixed" horizontally relative to support structure 20 and opening 36 on lower arm 32 defines a horizontal pivot axis 12 about which display panel 10 may be adjusted. Brackets 24 are generally provided as two (2) L shaped members arranged in a "Z" type pattern, however, brackets may be any type of projection extending from posts 22 that are intended to engage and support a backside surface of the display.

Figure 3A:
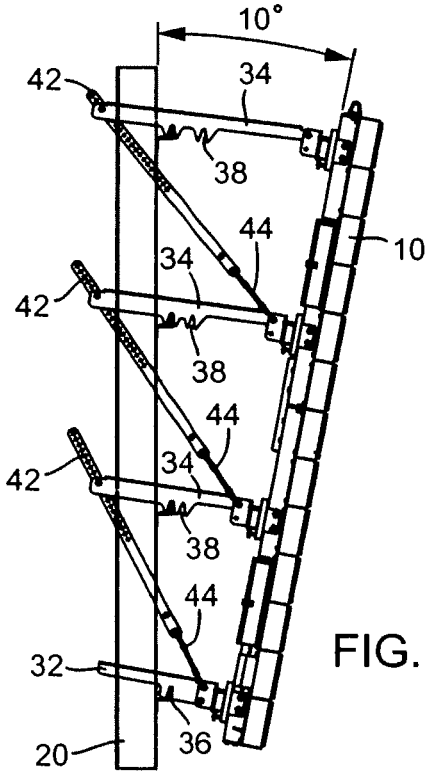
FIGS. 3A and 3B are side views of the adjustable mounting system of FIG. 2 according to an exemplary embodiment at several display angles.
Figure 3B:
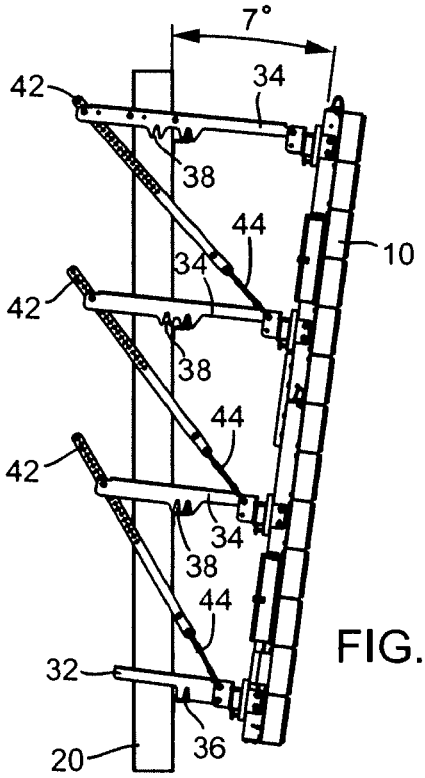
Figure 4:
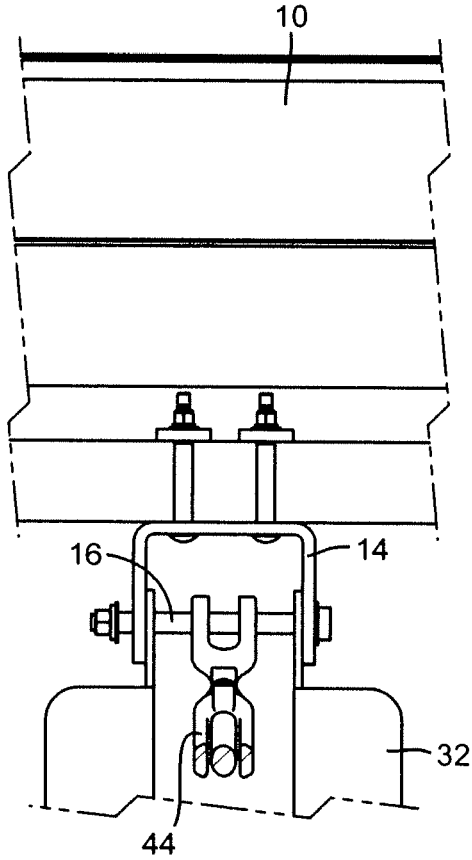
FIG. 4 is a cross section taken along line 4-4 showing a mechanism for coupling the adjustable mounting system to a display panel according to an exemplary embodiment.

Upper arms 34 are provided above lower arm 32 and are adjustable throughout a range of predetermined positions to support display panel 10 at multiple angles. Upper arms 34 may have different lengths as shown in FIGS. 3A and 3B or may be the same length and upper arms 34 closer to lower arm 32 may extend beyond support structure 20. Upper arms 34 each include one or more notches 38 (e.g., openings, recesses, etc.). Each notch 38 is configured to receive or otherwise engage a bracket 24 and corresponds to a particular angle of adjustment of display panel 10. The different angles allow display panel to be oriented such that the maximum light intensity from the LEDs on display panel 10 is directed more particularly at a ground-level observer at a given distance from the sign. The notches 38 associated with each particular angle are generally aligned with similar notches on each upper arm 34 (e.g., along the same radius extending from the pivot point formed horizontal axis 12). Therefore the notches 38 on the upper arm furthest from lower arm 32 are more spaced apart than those on the upper arm closest to lower arm 32. As shown in one exemplary embodiment, notches 38 are provided to support display panel 10 at a tilted or angled position of approximately 7 degrees (FIG. 3A) and approximately 10 degrees (FIG. 3B) from a vertical plane. More or fewer notches may be provided in other exemplary embodiments to vary the range and/or precision with which display panel 10 may be adjusted. The shape or profile of notches 36 on arms 32 and notches 38 on arms 34 allow adjustable mounting system 30 to move relative to support structure 20 and support display panel 10 at a variety of angles. For example, the range of predetermined angles may be approximately zero (0) degrees through thirty (30) degrees or more, and more particularly within the range of approximately three (3) degrees through twenty-five (25) degrees, and all such angles of adjustment are intended to be within the scope of the disclosure.

According to one exemplary embodiment, three generally equally spaced upper arms 34 are provided along each post 22. According to other exemplary embodiments, more or fewer upper arms may be provided or the upper arms may be differently spaced (e.g., because of different spacing of brackets 24 on support structure 20, etc.).

Brace 40 (e.g., support members, tensioning members, etc.) may be adjusted to provide a desired level of tension and support to maintain display panel 10 at a desired position and level. Brace 40 includes a static portion, shown as straps 42 in FIG. 2, and an adjustable portion such as a turnbuckle 44. Straps 42 are coupled to the end of upper arms proximate to support structure 20. Each turnbuckle 44 is coupled on one end to a pair of straps 42 and on the opposite end to a yoke 14 with coupling member 16. Because the length that each brace 40 must span is different for different angles of adjustment (e.g., braces 40 provided closer to lower arm 32 have a shorter span than braces 40 further from lower arm 32), straps 42 coupled to each upper arm 34 may be different lengths. According to one exemplary embodiment, shown in FIGS. 1-4, straps 42 are similar members and include a multitude of openings 46 that allow straps 42 to be coupled to upper arms 34 at different positions (e.g., with a bolt, etc.). Turnbuckle 44 may be adjusted to make finer adjustments to the overall length of each brace 40.

According to one exemplary embodiment, a display panel 10 is coupled to a support member 20 using an adjustable mounting system 30 by coupling the first ends of lower arm 32 and upper arms 34 to display panel 10 (e.g. by passing coupling member 16 through openings in arms 32 and 34 and yokes 14); fitting notch 36 in lower arm 32 and one notches 38 in each of upper arms 34 over a corresponding bracket 24 on one of the plurality of posts 22; and connecting at least one brace 40 between two of the arms (e.g., between an upper arm 34 and a neighboring upper arm 34 or between an upper arm 34 and lower arm 32). Braces 40 may then be adjusted to any one of a plurality of positions to accommodate tilting of display panel 10 about axis 12 to any one of the plurality of predetermined viewing angles.

According to any preferred embodiment, an adaptable mounting system for mounting an LED display panel on an existing support structure for a billboard is provided (e.g. when replacement of a conventional billboard sign is desirable without replacement of the underlying support structure). The existing support structure may including a plurality of posts each having brackets arranged to support the billboard. The adaptable mounting system includes a lower arm and several upper arms, with each arm having a first end and a second end and one or more notches configured to be supported on (e.g. received by, etc.) the brackets of the existing support structure. A yoke is coupled to each of the arms at or near the first end for attachment to members (e.g. stringers or the like) on the back of the LED display panel. A brace is coupled to the upper arms proximate the second end and coupled to the yoke of a lower arm beneath the upper arms.

Figure 5A:
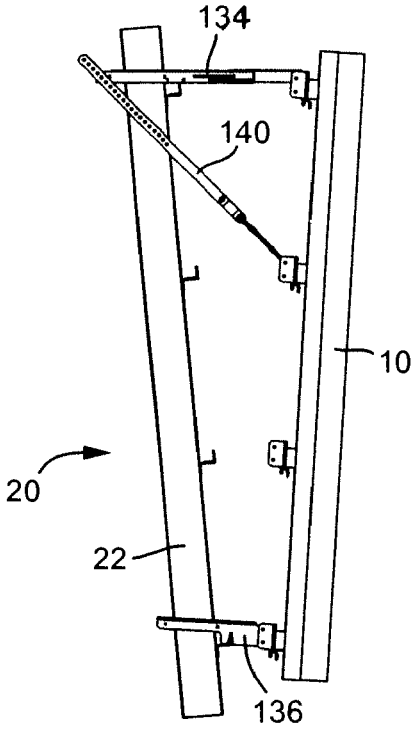
FIGS. 5A and 5B are side views of an adjustable mounting system according to another exemplary embodiment.
Figure 5B:
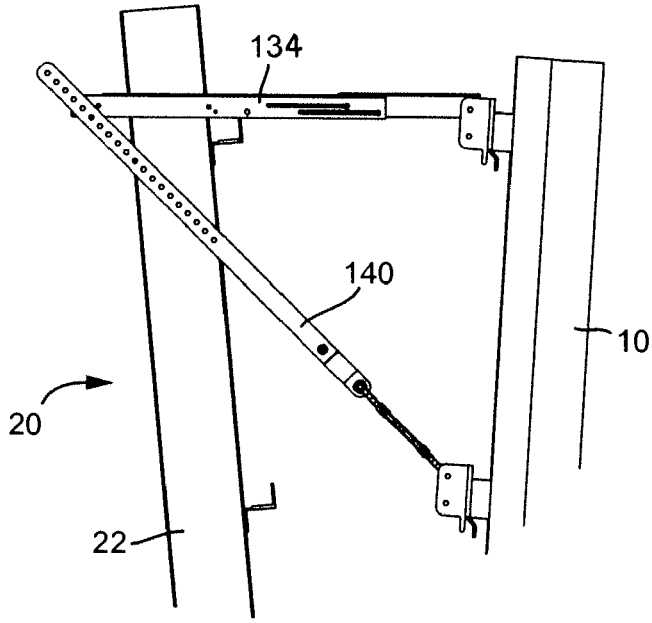

According to an alternative embodiment shown for example in FIGS. 5A-5B, an adaptable mounting system for mounting an LED display panel 10 on an existing support structure 20 for a billboard may include other components. For example, the arm members may be substituted with slide rods or bars 134 (e.g. telescoping, extendable-retractable, etc.) having adjustment slots (or the like) to provide a relatively infinitely adjustable arrangement that may be fixed or secured in-place once the desired angle is achieved during mounting of the sign. The LED display panel 10 may have a lower end of its structure coupled to a lower bracket on the existing post of the support structure (e.g. by a support arm 136), and then the display panel may be "dialed-in" to the desired angle (e.g. hydraulically by a suitable jack or press or ram, or mechanically using suitable jacks, winches, etc.), and then the slide rods may be fixed in place to secure the display panel in the desired position by clamping, welding or other suitable method. The system may include a single slide rod (as shown by way of example in FIGS. 5A-5B) or may include multiple slide rods as desired to provide support to a particular display panel installation. In addition, one or more braces 140 may be provided; alternatively braces may be omitted and the resistance to bending moment may be provided at the connection of the slide rod(s) to the post 22. Alternatively, other components may be used, such as jack bolts, ball screws, turnbuckles, etc. for providing an adjustable connection between the LED display panel and the post and/or brackets of the existing support structure. Accordingly, all such variations are intended to be within the scope of this disclosure.

It is important to note that the construction and arrangement of the elements of the adjustable mounting system provided herein are illustrative only. Although only a few exemplary embodiments of the present invention(s) have been described in detail in this disclosure, those skilled in the art who review this disclosure will readily appreciate that many modifications are possible in these embodiments (such as variations in features such as connecting structure, components, materials, sequences, capacities, shapes, dimensions, proportions and configurations of the modular elements of the system, without materially departing from the novel teachings and advantages of the invention(s). For example, arm members may be provided in any desirable shape or contour (e.g. curved, etc.) to achieve optimum interconnection of the display panel to the support structure, or the number and/or spacing of the arms and/or notches may be varied to provide greater or fewer possible viewing angles. Further, it is readily apparent that variations and modifications of the adjustable mounting system and its components and elements may be provided in a wide variety of materials, types, shapes, sizes and performance characteristics. Accordingly, all such variations and modifications are intended to be within the scope of the invention(s).

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims

What is claimed is:

1. An adaptable mounting system for mounting an LED display panel on an existing support structure for a billboard, the support structure including a plurality of posts having brackets arranged to support the billboard, the adaptable mounting system comprising:

a lower arm and a plurality of upper arms, each arm having a first end and a second end and one or more notches configured to be supported on the brackets of the existing support structure;

a yoke coupled to the arms proximate the first end and configured for attachment to the LED display panel; and a brace coupled to one of the upper arms proximate the second end and coupled to the yoke of an arm beneath the one of the upper arms.

2. The adaptable mounting system of claim 1 wherein the lower arm includes a single notch that provides a pivot point for the LED display sign.

3. The adaptable mounting system of claim 2 wherein the upper arms include a two or more notches for tilting the LED display sign about the pivot point to a predetermined viewing angle.

4. The adaptable mounting system of claim 1 wherein the predetermined viewing angle comprises a plurality of angles generally within the range of 3 degrees through 25 degrees from a vertical plane.

5. The adaptable mounting system of claim 1 wherein the plurality of upper arms includes a first upper arm and a second upper arm and a third upper arm.

6. The adaptable mounting system of claim 5 wherein the brace comprises a first brace coupled to the first upper arm proximate the second end and coupled to the yoke of the second upper arm, and a second brace coupled to the second upper arm proximate the second end and coupled to the yoke of the first upper arm, and a third brace coupled to the third upper arm proximate the second end and coupled to the yoke of the lower arm.

7. The adaptable mounting system of claim 1 wherein the brace comprises an adjustable component.

8. The adaptable mounting system of claim 7 wherein the adjustable component comprises a turnbuckle.

9. The adaptable mounting system of claim 1 wherein the arms comprise two substantially parallel members joined together proximate the first end by the yoke and joined together proximate the second end at the post.

10. The adaptable mounting system of claim 9 wherein the two substantially parallel members are configured to clamp the post therebetween.

11. The adaptable mounting system of claim 1 wherein the arms and the yokes and the brace comprise an adaptable interface configured to mount the LED display sign to one of the plurality of posts, and further comprising a plurality of adaptable interfaces configured to mount the display sign to the other of the plurality of posts.

12. An adaptable mounting system for mounting an LED display panel on an existing support structure for a billboard, the support structure including a plurality of posts having brackets arranged to support the billboard, the adaptable mounting system comprising:

a lower arm having a first end coupled to the LED display panel and having an opening configured to fit over a lower one of the brackets on one of the posts to define a pivot axis about which the LED display sign may be tilted to any one of a plurality of predetermined viewing angles;

a plurality of upper arms each having two or more openings, the openings located on the upper arms to correspond to the plurality of predetermined viewing angles and configured to fit over upper ones of the brackets on the one of the posts, each upper arm also having a first end coupled to the LED display panel; and at least one brace extending between two of the arms and adjustable to any one of a plurality of positions to accommodate tilting of the LED display panel to any one of the plurality of predetermined viewing angles.

13. The adaptable mounting system of claim 12 wherein the lower arm and the upper arms and the brace comprise a connection set configured to mount the LED display panel on the one of the posts, and further comprising a plurality of connection sets configured to mount the LED display sign to the other of the plurality of posts.

14. The adaptable mounting system of claim 12 wherein the brace comprises two straps joined at one end to a turnbuckle.

15. The adaptable mounting system of claim 12 wherein the LED display panel comprises stringers and the first end of the arms are coupled to the stringers.

16. The adaptable mounting system of claim 12 wherein the at least one brace comprises a plurality of braces connected in a Z pattern with the arms.

17. A method of mounting an LED display panel on an existing support structure for a billboard, the support structure including a plurality of posts having brackets arranged to support the billboard, the method comprising:

providing a lower arm having an opening and having a first end;

coupling the first end of the lower arm to the LED display panel;

providing a plurality of upper arms each having two or more openings and having a first end;

coupling the first end of the upper arms to the LED display panel;

fitting the opening in the lower arm and one of the openings in each of the upper arms over a corresponding bracket on one of the plurality of posts; and connecting at least one brace between two of the arms.

18. The method of claim 17 further comprising the step of adjusting the brace to any one of a plurality of positions to accommodate tilting of the LED display panel to any one of the plurality of predetermined viewing angles.

19. The method of claim 17 further comprising the step of tilting the LED display panel about a pivot axis defined substantially by the opening on the lower arm.

20. The method of claim 17 further comprising the step of connecting a yoke to the first end of at least one arm, and to the LED display panel and to the brace.

* * * * *